US010145606B2

(12) United States Patent
Pelka

(10) Patent No.: US 10,145,606 B2
(45) Date of Patent: Dec. 4, 2018

(54) PRODUCT LIGHTING REFRIGERATION DOOR

(75) Inventor: David G. Pelka, Los Angeles, CA (US)

(73) Assignee: Seoul Semiconductor Co., Ltd., Ansan-si (KR)

( * ) Notice: Subject to any disclaimer, the term of this patent is extended or adjusted under 35 U.S.C. 154(b) by 392 days.

(21) Appl. No.: 13/996,396

(22) PCT Filed: Apr. 24, 2012

(86) PCT No.: PCT/US2012/034834
§ 371 (c)(1),
(2), (4) Date: Sep. 13, 2013

(87) PCT Pub. No.: WO2012/148928
PCT Pub. Date: Nov. 1, 2012

(65) Prior Publication Data

US 2013/0343036 A1 Dec. 26, 2013

Related U.S. Application Data

(60) Provisional application No. 61/479,266, filed on Apr. 26, 2011.

(51) Int. Cl.

| | |
|---|---|
| ***F25D 27/00*** | (2006.01) |
| ***A47F 3/04*** | (2006.01) |
| ***A47F 11/10*** | (2006.01) |
| *F25D 23/02* | (2006.01) |
| *F21W 131/405* | (2006.01) |
| *F21Y 115/10* | (2016.01) |

(52) U.S. Cl.
CPC ..... *F25D 27/00* (2013.01); *A47F 3/0434* (2013.01); *A47F 11/10* (2013.01); *F21W 2131/405* (2013.01); *F21Y 2115/10* (2016.08); *F25D 23/02* (2013.01); *Y10T 29/49826* (2015.01)

(58) Field of Classification Search
CPC .. G02B 6/0036; G02B 6/0038; G02B 6/0046; G02B 6/0016; G02B 6/0058; G02B 6/0061; G02B 6/0063; G02B 6/0035; G02B 6/0015; A47F 11/10; A47F 3/0434; F25D 27/00; F21W 2131/405
USPC ..... 362/125, 600–634
See application file for complete search history.

(56) References Cited

U.S. PATENT DOCUMENTS 5,471,372 A 11/1995 Mamelson et al.
5,555,329 A 9/1996 Kuper et al.
(Continued)

OTHER PUBLICATIONS

PCT International Search Report and Written Opinion, dated Nov. 5, 2012, on PCT International Application No. PCT/US2012/034834, (6 pgs.).

*Primary Examiner* — Zheng Song
(74) *Attorney, Agent, or Firm* — H.C. Park & Associates, PLC

(57) ABSTRACT

An illustrative refrigeration unit door includes a transparent window portion that receives light from a light source such that the light exhibits total internal reflection within the window portion. A series of uniformly-sized prisms with non-uniform spacing ejects light from one face of the transparent window portion at angles around 60 degrees and 30 degrees. Collimated light can be used to reduce the amount of light ejected from a second face of the transparent window that is opposite the first face.

11 Claims, 7 Drawing Sheets

(56) References Cited

U.S. PATENT DOCUMENTS 5,724,108 A * 3/1998 Shibata ..... G02B 6/0053 349/62
5,739,931 A 4/1998 Zimmerman et al.
6,092,904 A 7/2000 Tai et al.
6,123,431 A * 9/2000 Teragaki ..... G02B 6/0036 362/333
6,129,439 A 10/2000 Hou et al.
6,144,536 A 11/2000 Zimmerman et al.
6,210,013 B1 4/2001 Bousfield
6,305,811 B1 10/2001 Beeson et al.
6,330,386 B1 * 12/2001 Wagner ..... G02B 6/0061 349/63
6,575,584 B1 6/2003 Habraken
6,767,106 B2 7/2004 Barnes et al.
6,833,565 B2 12/2004 Su et al.
7,431,489 B2 10/2008 Yeo
7,452,120 B2 11/2008 Lee et al.
7,513,637 B2 4/2009 Kelly et al.
7,559,672 B1 7/2009 Parkyn et al.
7,731,395 B2 6/2010 Parkyn et al.
7,824,056 B2 11/2010 Madireddi et al.
8,142,038 B2 3/2012 Li et al.
8,411,364 B2 4/2013 Fox et al.
2003/0034445 A1 * 2/2003 Boyd ..... G02B 6/0038 250/227.11
2003/0117793 A1 * 6/2003 Shin ..... G02B 6/0025 362/609
2003/0128538 A1 * 7/2003 Shinohara ..... G02B 6/0016 362/610
2003/0160911 A1 * 8/2003 Kano ..... G02B 6/0028 349/65
2004/0062031 A1 * 4/2004 Pinter ..... A47B 96/02 362/612
2005/0286854 A1 * 12/2005 Honma ..... G02B 6/0048 385/146
2007/0274097 A1 * 11/2007 Chen ..... G02B 6/0036 362/609
2007/0279727 A1 * 12/2007 Gandhi ..... G02B 6/0035 359/242
2009/0135623 A1 * 5/2009 Kunimochi ..... G02B 6/0016 362/608
2009/0272136 A1 * 11/2009 Knoll ..... A47F 3/001 62/251
2009/0296383 A1 12/2009 Valster et al.
2010/0277949 A1 * 11/2010 Weng ..... G02B 6/0036 362/607
2010/0281910 A1 11/2010 Riemeijer et al.
2011/0079034 A1 4/2011 Kim et al.
2011/0170036 A1 * 7/2011 Ishikawa ..... G02B 6/0016 349/65
2012/0140518 A1 * 6/2012 Solomon ..... G02B 6/0016 362/607

* cited by examiner

PRODUCT LIGHTING REFRIGERATION DOOR

CROSS REFERENCE TO RELATED APPLICATIONS

This application claims the benefit of U.S. Provisional Application No. 61/479,266, filed Apr. 26, 2011.

BACKGROUND

The following description is provided to assist the understanding of the reader. None of the information provided or references cited is admitted to be prior art.

Light Emitting Diodes (LEDs) have recently surpassed 100 lumen/Watt (lm/W) efficacy and, as such, are now around 7 times as efficient as incandescent lamps and about 2 to 3 times as efficient as compact fluorescent lamps. LEDs, therefore, are now a viable option for use in many applications to replace former light sources.

Refrigeration and freezer units can use incandescent lamps or compact fluorescent lamps. To attract consumers' attention, products stored in refrigeration or freezer units need to be clearly visible. Lighting and transparent doors are ways that ensure the products are illuminated. Lighting typically consists of a light source located within the refrigeration units that are separate from the door. The light source, therefore, operates independently from the door, and the opening and closing of the door has little to no impact on how the encased products are illuminated.

SUMMARY

The present invention relates to a door of a refrigeration or freezer unit that illuminates products within a refrigeration unit without creating glare when the door is either opened or closed.

An illustrative refrigeration unit door includes a light source, a window portion, and a plurality of uniformly-sized prisms that are non-uniformly spaced. The window portion receives light from the light source at a first face and the light exhibits total internal reflection in the window portion. The plurality of prisms ejects light from a second face of the window portion at angles between 10 and 80 degrees.

An illustrative process of manufacturing a refrigeration unit door comprises attaching a light source to the refrigeration unit door. The light source emits light to a first face of a window portion and the light exhibits total internal reflection within the window portion. A plurality of uniformly-sized prisms that are non-uniformly spaced are affixed to the window portion. The prisms eject light from a second face of the window portion at angles between 10 and 80 degrees.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1A:
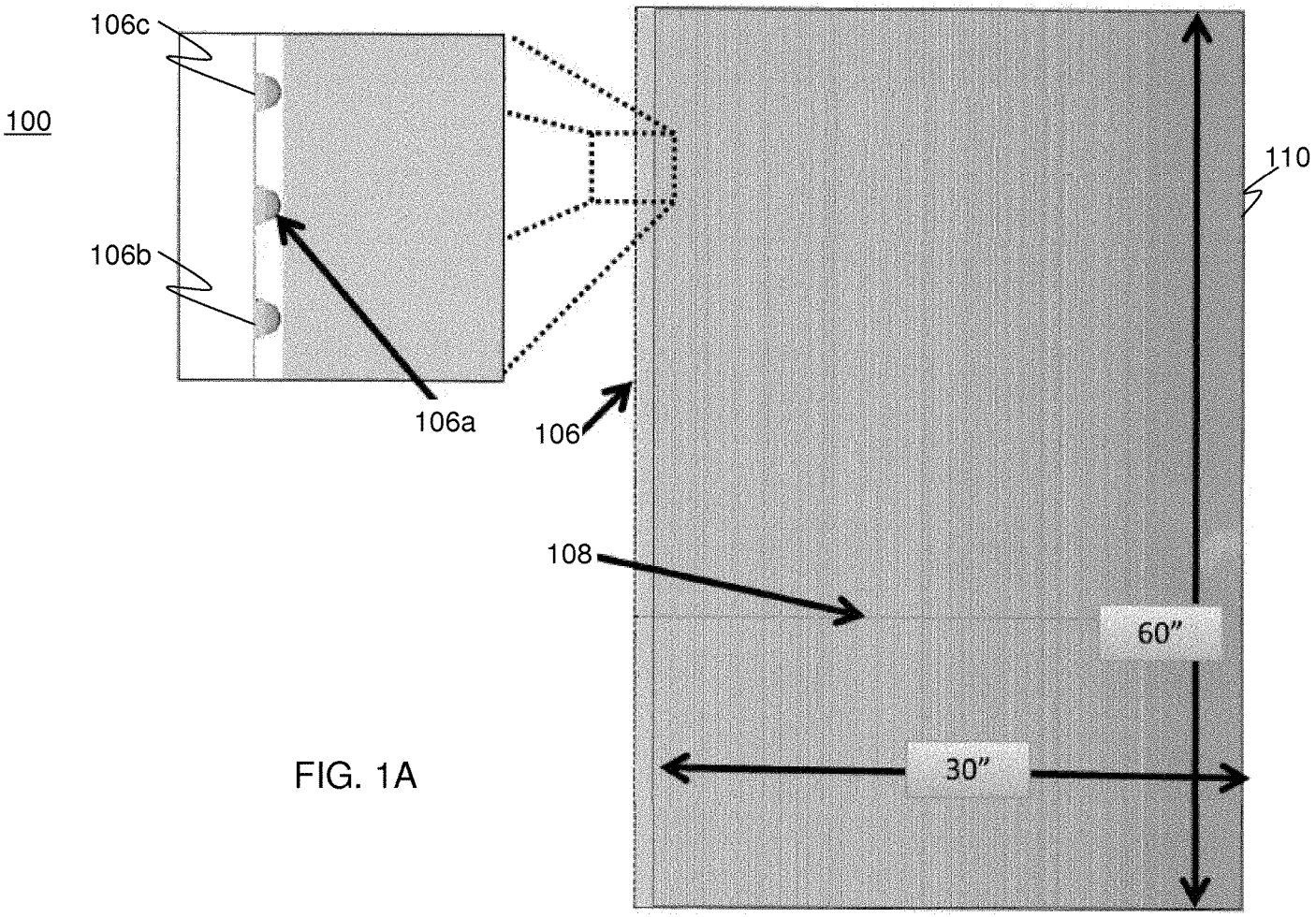
FIG. 1A is a front elevation view of a refrigeration unit door in accordance with an illustrative embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Described herein are illustrative illuminating doors for use in refrigeration and/or freezer units. The term refrigeration unit is used interchangeably with freezer unit. In an illustrative embodiment, a refrigeration door includes multiple light sources, for example light-emitting diodes (LEDs), which provide light to a transparent window pane of the refrigeration door. The light sources can be located at any of the edges of the window pane. Upon entering the window portion, the light exhibits total internal reflection, such that the light stays within the window pane.

Because the light stays within the window pane due to total internal reflection, to provide lighting or additional lighting to products within the refrigeration unit, the light from the light sources must be ejected toward the interior of the refrigeration unit. An illustrative way of achieving this is by attaching a thin film containing a number of uniformly-sized prisms to the window pane. In an exemplarily embodiment, the prisms are between 20 to 30 micrometers in size. While prisms can provide a way to eject the light, the angle of the ejected light is important. To avoid unwanted glare or light being ejected onto the person opening the door, the light should be ejected at an angle that is not perpendicular to the open door. In an exemplarily embodiment, 90/30/60 prisms are used to eject light at around a 60-degree angle for light traveling in a first direction and at around a 30-degree angle for light traveling in a second direction. The second direction is substantially opposite to the first direction. In one embodiment, 95% of the ejected light that was traveling in the first direction is ejected from the prisms at an angle of 60 degrees plus or minus 2 degrees. In this embodiment, 95% of the ejected light that was traveling in the second direction is ejected from the prisms at an angle of 30 degrees plus or minus 2 degrees. In other embodiments, other angles of ejection are possible such as 10 degrees, 20 degrees, 45 degrees, 75 degrees, 80 degrees, etc.

The light loses intensity as it travels in the first direction through the window pane away from the light source as a result of some of the light being ejected by the prisms. To achieve uniform lighting, the prisms are non-uniformly spaced. The prisms are spaced closer to one another as the prisms get farther away from the light source. This ensures that the light ejected from the window pane is relatively uniform along the entire window pane.

Any light that is not ejected during a first pass through the window pane can be reflected back into the pane using a reflective material that coats the edge of the window pane opposite the light sources. Light that is reflected back, in the second direction, into the window pane also needs to be ejected at some non-perpendicular angle. In the exemplarily embodiment using the 90/30/60 prisms, the reflected light can be ejected at around a 30-degree angle.

In an illustrative embodiment, an open refrigeration unit door ejects light into the refrigeration unit. To avoid an unwanted glare seen by consumers passing an open door, the amount of light ejected from the window pane away from the refrigeration unit should be minimized or eliminated. Thus, the prisms are configured to eject light into the refrigeration unit, but not away from the refrigeration unit. In an exemplary embodiment, collimated light is used to minimize the amount of light ejected away from the refrigeration unit. For instance, a collimated light to +/−15 degrees significantly reduces the amount of light ejected away from the refrigeration unit. In one embodiment a collimator is operably coupled between the LED light source and the input edge of the pane. The collimator further collimates the light, which reduces the amount of light ejected away from the refrigeration unit. In one embodiment, the collimator collimates the light to +/−7 degrees.

The window pane can also include an anti-reflective coating on one or both sides of the window pane. The anti-reflective coating reduces or eliminates visible streaks than can be created by the multiple light sources when an anti-reflective coating is not used.

In another embodiment, the window pane comprises three panes of glass or other suitable transparent material. The LED light source can enter any of these panes. The thin film of prisms can be operably connected to any of the panes that include an LED light source. In some embodiments, the different panes provide insulation and anti-fogging properties. In one embodiment, the anti-reflective coating can be added to an innermost interior pane and the LED light source can enter the middle pane. A second anti-reflective coating can be applied between the innermost interior and middle panes to further reduce reflection and unwanted glare.

Additional details and embodiments are described with reference to the figures. FIG. 1A is a front elevation view of a refrigeration unit door in accordance with an illustrative embodiment. The door 100 includes a window pane 108 and a lighting portion 106. The lighting portion 106 can include one or more light sources 106*a*, 106*b*, and 106*c*. The light sources can be a bullet LED, surface mount LED, etc. The window pane 108 includes a prism portion (shown in FIG. 1B) that ejects light from the light sources of the lighting portion 106. The door 100 can include a reflective coating 110 at the edge of the door 100 opposite of the lighting portion 106. Light that is not ejected by the prism portion is reflected back into the door 100 by the reflective coating 110. The reflected light travels back through the door 100 toward the lighting portion 106 and can be ejected from the door 100 by the prism portion. In one embodiment, the reflected light is ejected from the door at around 30 degrees. The door 100 can be various sizes, and in one embodiment, is 30 inches by 60 inches.

Figure 1B:
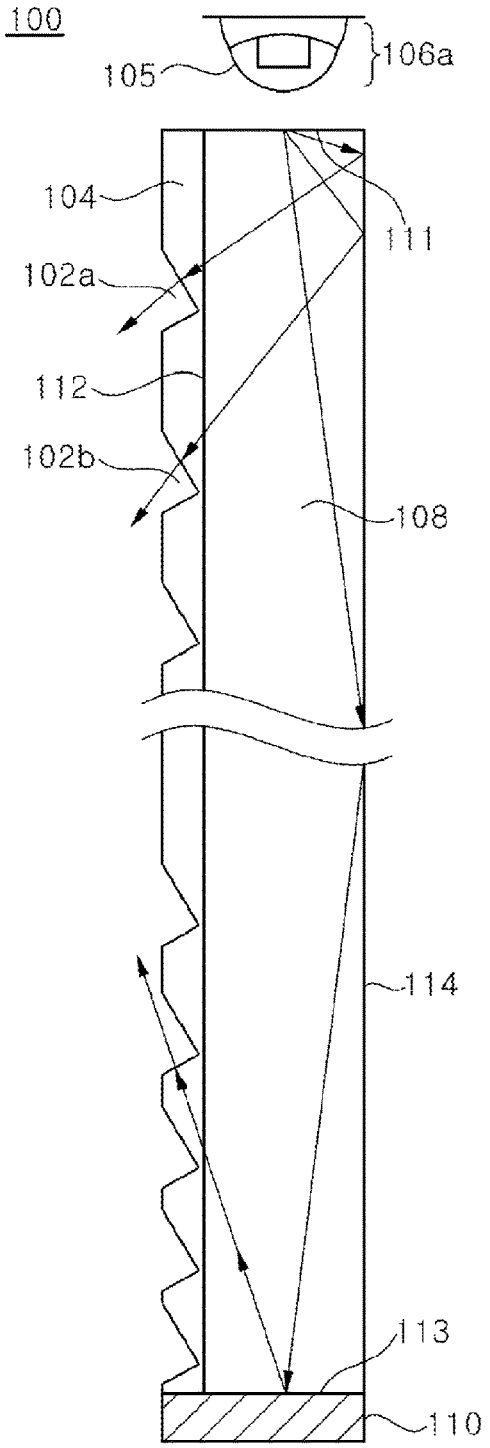
FIG. 1B is a cross-section view of a refrigeration unit door in accordance with an illustrative embodiment.

FIG. 1B is a cross-section view of a refrigeration unit door in accordance with an illustrative embodiment. The door 100 can include a window pane 108 and a prism portion 104. The window pane 108 can be comprised of, but is not limited to, glass, transparent plastic such as acrylic or polycarbonate, etc. In one embodiment, the prism portion 104 is an ultra-violet-cured thin film that includes the prisms 102*a* and 102*b*. In one embodiment, the prisms 102*a* and 102*b* are air prisms and are formed by notches in the thin film. In an exemplarily embodiment, the thin film is 25 micrometers thick and has an index of refraction of 1.50. The film can be attached to the window pane 108 using standard adhesives. In an alternative embodiment, the prisms 102*a* and 102*b* are etched directly into the window pane 108, thus foregoing the need for the prism portion 104. In yet another embodiment, the prisms can be cast directly on the window pane 108. In this embodiment, a polymer coating is applied directly on the window pane 108 and a prismatic mold is applied to the polymer coating. Ultraviolet light can be used to cure the prisms directly on the glass.

In another embodiment, a substrate layer (not shown) can be included that is between the window pane 108 and the prism portion 104. The substrate layer can be used to achieve total internal reflection of the light from a light source 106 within the window pane 108.

A light source 106 provides light that will be ejected by the prisms 102*a* and 102*b*. As FIG. 1B is a cross section of a window pane, only a single light source 106 is shown. In an illustrative embodiment, a refrigeration unit door has multiple light sources 106*a*, 106*b*, and 106*c* of FIG. 1A that can be either uniformly or non-uniformly spaced. The light source can be, but is not limited to, a bullet LED, surface mount LED, etc. In an alternative embodiment, a refrigeration unit door has only a single light source. In this embodiment, the single light source is located in a corner of the refrigeration unit door 100 and provides light that is perpendicular to the prisms. A number of steps interspaced along an edge of the window pane eject a portion of light from the single light source into the window pane. The light is then ejected from the window pane using the prisms in the same manner as in the multiple light-sources embodiment.

In embodiments using multiple light sources, the light sources can be placed along any edge of the door 100. For instance, the light sources can be at the top, bottom, left, or right side of the door 100. Based upon the location of the light sources, the prisms 102*a* and 102*b* can be positioned vertically or horizontally along the door 100. In embodiments using a single light source, the light source can be located near any corner of the door 100. The steps can be located along any of the edges of the door 100 based upon the location of the single light source.

Figure 6:
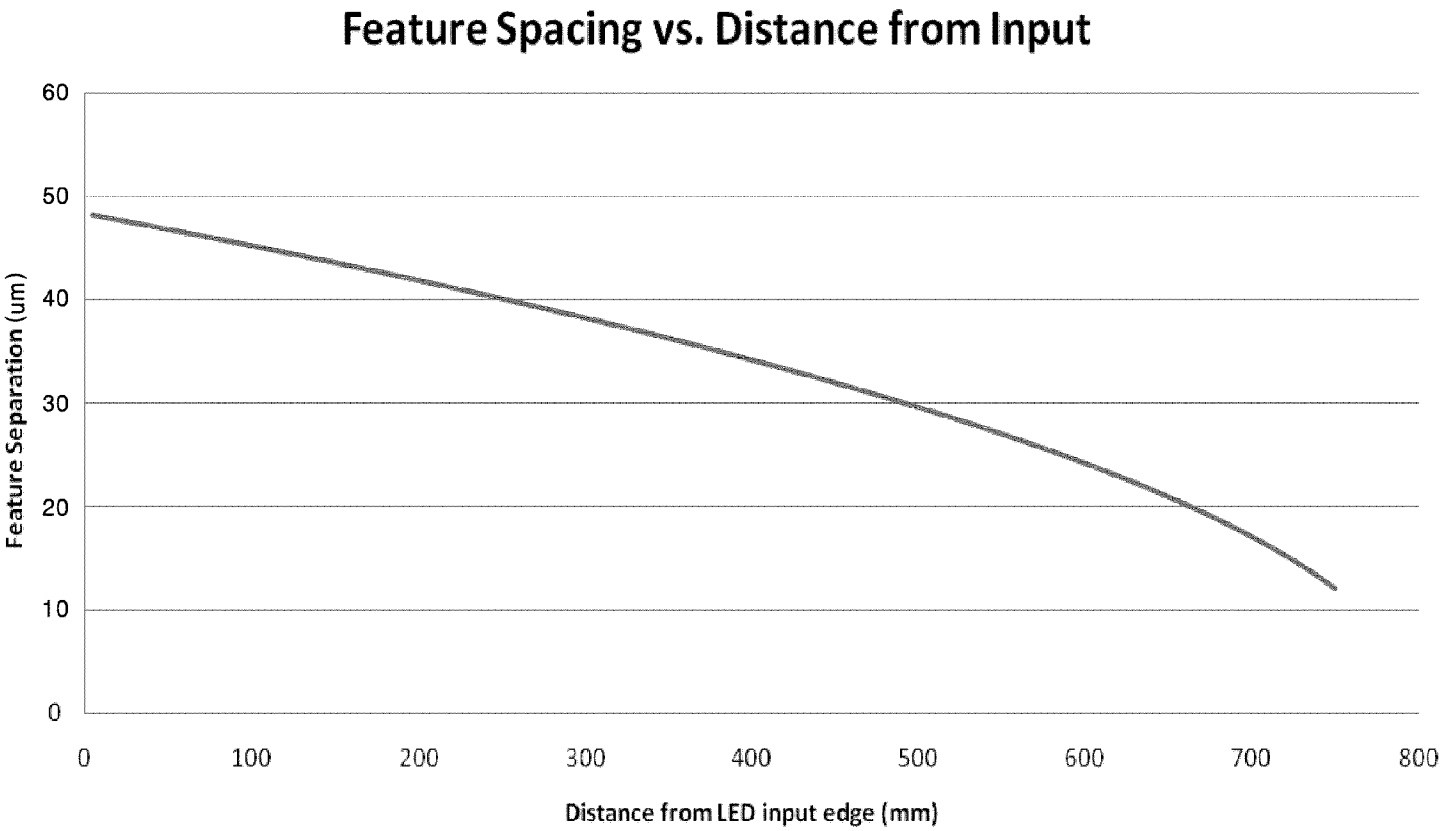
FIG. 6 is a graph illustrating the distance between prisms based upon the distance from an LED input edge in accordance with an illustrative embodiment.

The door 100 of FIG. 1B illustrates prisms 102 *a* and 102 *b*. A full-size door, however, will have multiple prisms. The number of prisms can be, but is not limited to, 10, 100, 250, 500, etc. The intensity of the light as it travels through the window pane 108 is reduced. The reduction of intensity is due to a portion of the light being ejected through prisms. To ensure a relatively constant intensity of light through the window pane 108, the prisms must be spaced closer together the further the prisms are away from the edge of the window pane 108 that receives the light. In an exemplarily embodiment, the first prism is positioned about 20 millimeters from the edge of the window pane 108 that receives the light. Additional prisms are spaced closer and closer, where the last prism is 1.25 millimeters (mm) from the previous prism. The prisms are spaced according to the graph as illustrated in FIG. 6.

According to an illustrative embodiment, the light source 106*a* including a collimator 105 emits light towards a first face 111 of the window pane 108, as shown in FIG. 1B. Prisms 102*a* and 102*b* are disposed on a second face 112 of the window pane 108, and provide a way to eject light to the outside from the door 100. The prisms 102*a* and 102*b* according to an illustrative embodiment may each be a 90/30/60 prism, such that light from the light source 106*a* is ejected at around 60-degree angle to the outside via one of 30-degree face and 60-degree face of the prisms 102*a* and 102*b*. The door 100 further includes a reflective coating 110 disposed on a third face 113 of the window pane 108, which reflects non-elected light back to the door 100. The reflected light then is ejected at around 30-degree angle to the outside via the other one of the 30-degree face and 60-degree face of the prisms 102*a* and 102*b*. The prisms 102*a* and 102*b* are spaced apart from each other, and a distance between adjacent prisms decreases as the prisms 102*a* and 102*b* are disposed further away from the light source 106, as shown in FIGS. 1B and 6. In this manner, light is elected at an angle that is not perpendicular to the open door 108, thereby preventing unwanted glare to a user and providing a uniform light.

Figure 4:
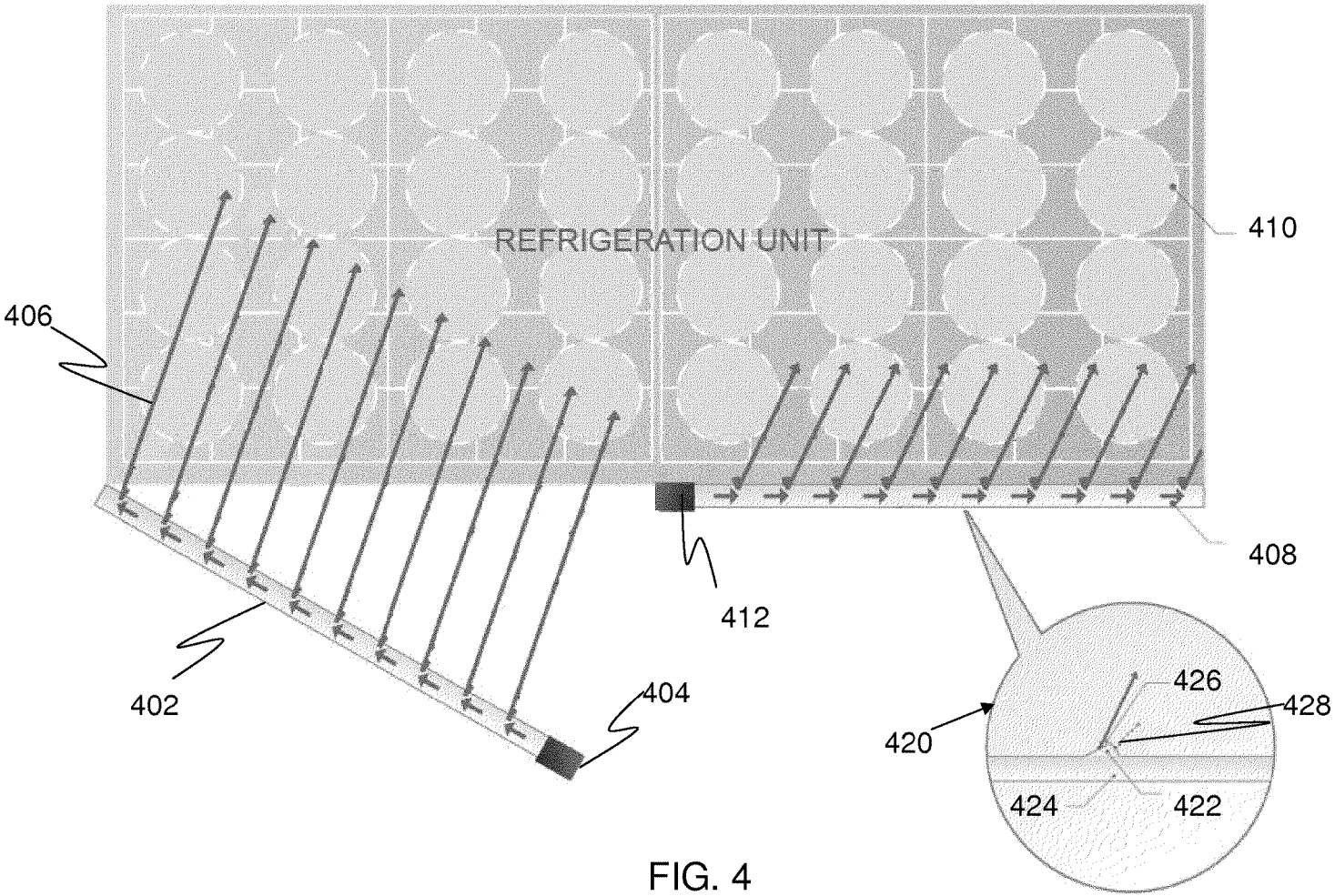
FIG. 4 is an overhead view of two refrigeration doors in accordance with an illustrative embodiment.

The spacing of prisms illustrated in FIG. 4 takes into account only light traveling through the window pane during a first pass from the entry edge to the opposite edge of the door 100. In an illustrative embodiment, a reflective coating 110 is placed on the edge of the door 100 opposite where the light enters the window pane. Light that is not ejected from the door 100 reflects back into the window pane due to the reflective coating 110. The reflective light is substantially weaker than the light that is emitted from the light source 106. In an illustrative embodiment, 85% of the light is ejected during the first pass and 10% of the light is ejected after being reflected. The spacing of the prisms can be modified to take into account the reflected light. In one embodiment, the spacing of a set of prisms that is closest to the edge containing the reflective coating is increased. In one embodiment, the spacing between the sixth and fifth prisms closest to the reflecting coating 110 is used as a constant spacing between the last five prisms. In another embodiment, the spacing between the last five prisms is increased by a factor corresponding to the spacing between the sixth and fifth prisms closest to the reflecting coating 110.

Figure 2:
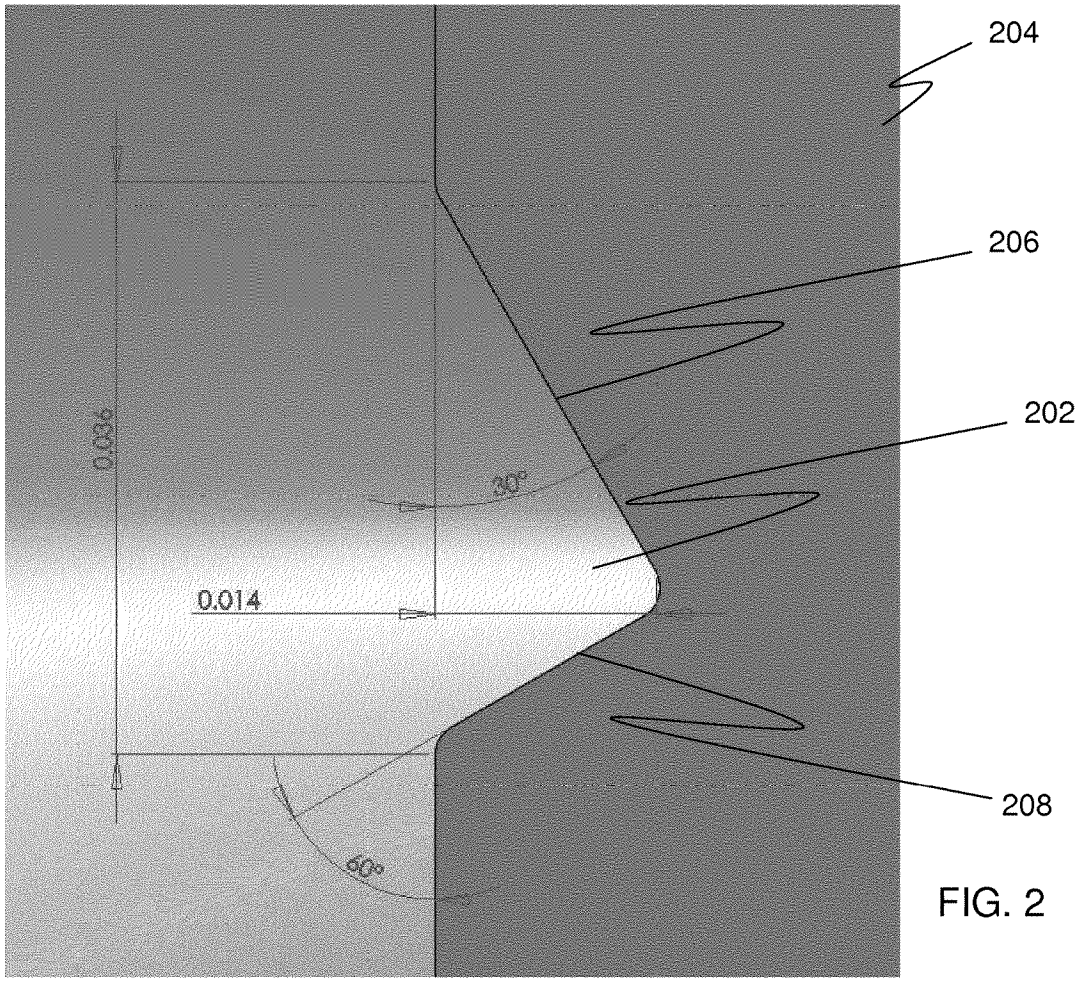
FIG. 2 illustrates a single air prism in accordance with an illustrative embodiment.

FIG. 2 illustrates a single air prism in accordance with an illustrative embodiment. In one particular embodiment, a prism portion 204 can include multiple prisms, such as prism 202. In this embodiment, the depth of the prism is 0.014 inches and the length of the prism is 0.036 inches. In this embodiment, the prism 202 is a 30/60/90 degree prism, such that light in the prism portion 204 is refracted at around a 60 degree angle by a first face 206. Light that is not dispersed from the prism portion 204 and a window pane (108 of FIG. 1A) is reflected from a reflecting coating (110 of FIG. 1A) and portions of the reflected light can be refracted at around a 30 degree angle by a second face 208.

Figure 3:
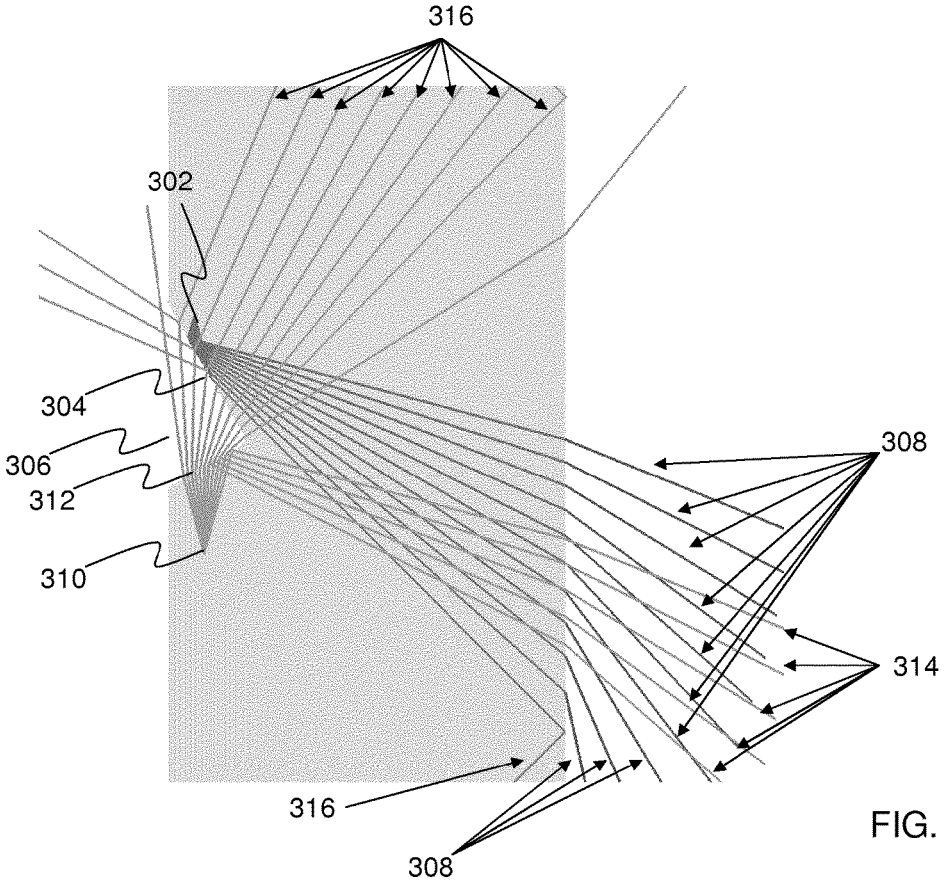
FIG. 3 illustrates refracting light from a single prism in accordance with an illustrative embodiment.

FIG. 3 illustrates refracting light from a single prism in accordance with an illustrative embodiment. Light 302 enters a first face 304 of a prism 306. Portions of the light 308 are transmitted in a desired illumination direction. The desired direction can be, but is not limited to, being 30 degrees, 45 degrees, 60 degrees, etc. The light 302 can be directly from a light source or can be light that was not transmitted out of a medium by a previous prism. Light that is not directed out of the medium can be reflected back into the medium by a reflective surface that is opposite of the edge where the light entered. Reflected light 310 can also be transmitted in the desired illumination direction. A portion of the reflected light 314 is transmitted in the desired direction by a second face 312 of the prism. The reflected light 310 can be reflected light directly from the reflective edge or it can be reflected light that was not transmitted out of the medium by a previous prism. Light that is not ejected 316 can be recaptured by the medium and a later prism can eject the light.

FIG. 4 illustrates an overhead view of a refrigeration unit 400 with two refrigeration doors in accordance with an illustrative embodiment. An open refrigeration door 402 ejects light 406 from a light source 404 into the refrigeration unit. The light ejected into the refrigeration unit by the open refrigeration door 402 illuminates the products 410 contained with the refrigeration unit. A closed refrigeration unit door 408 also ejects light from a light source 412 into the refrigeration unit 400. Portions of FIG. 4 do not illustrate the effects of the reflective coating 110. Area 420, however, does illustrate a prism 422 and its effect on reflected light. The area 420 is a more detailed view of a portion of the refrigeration door 408. The prism 422 ejects light from a window pane 424 of the refrigeration door 408. In one embodiment, light traveling away from the light source is ejected at around 60 degrees 426. Light that is reflected back into the door and traveling toward the light source is ejected out of the prism 422 at an angle around 30 degrees 428.

Figure 5:
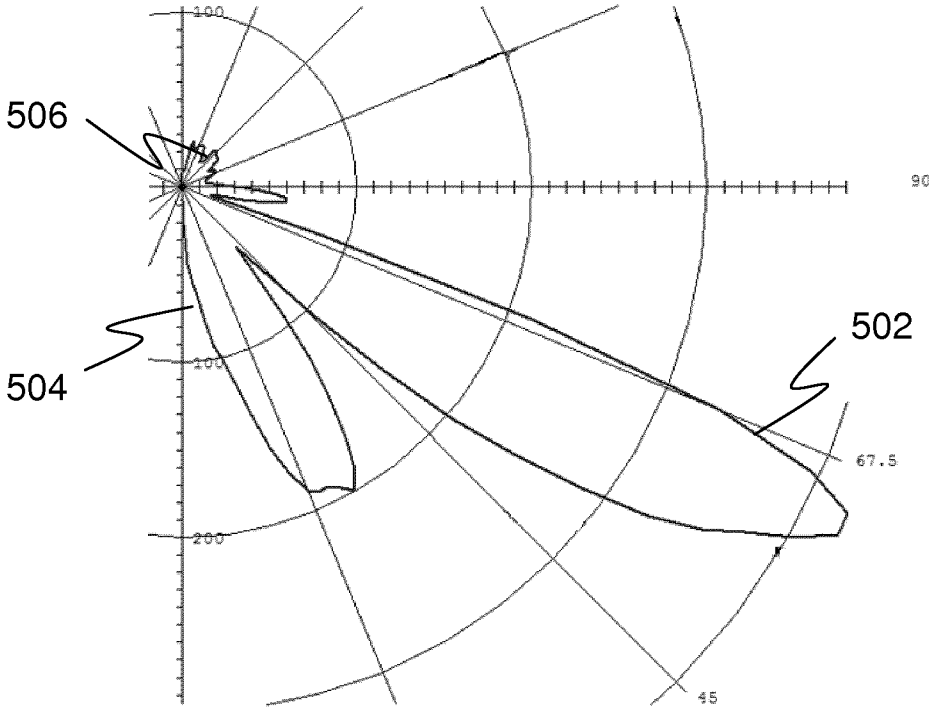
FIG. 5 is a graph illustrating the angle of the light ejected from a refrigeration door in accordance with an illustrative embodiment.

FIG. 5 is a graph illustrating the angle of the light ejected from a refrigeration unit door in accordance with an illustrative embodiment. Lobe 502 illustrates light that is ejected at around 60 degrees from the window pane. This light is from the first pass of the light through the window pane. Light that is reflected off of the reflective coating and passes through the window pane a second time is ejected at around a 30-degree angle and is illustrated by the second lobe 504. Light that is ejected out of the window pane but away from the refrigeration unit is illustrated by the area 506. This light can cause glare for consumers passing an open refrigeration unit door. Collimated light can be used to significantly reduce the amount of light ejected away from the refrigeration unit. Using a collimated light of +/−10 can significantly reduce this unwanted ejection of light. FIG. 5 illustrates using a collimated light source of +/−80. Using a +/−10 collimated light source can reduce the amount of light ejected away from the refrigeration unit by about 50%.

In addition to the various refrigeration door embodiments described above, one of skill in the art would recognize numerous other applications of the above disclosed invention. For example, a troffer can incorporate a prism portion that directs light at various angles to minimize glare on surfaces such as a CRT screen. In another embodiment, a window can include a prism portion that provides an indirect lighting source. For example, an exterior window can include a layer of prisms that ejects light, such as light from the sun, into an interior at particular angles, such as 60 degrees. In one embodiment, the prisms are configured such that the light is ejected toward a particular portion of the interior, such as, but not limited to, the floor, walls, the ceiling, the center of the room, an object within the room, etc. In one embodiment, the prisms do not eject light at a common angle. Instead, the prisms can eject light out at different angles, such that the light is focused onto a particular area of the interior. In yet another embodiment, a prism portion can be used in a reach-in refrigeration case to illuminate products contained therein.

With respect to the use of substantially any plural and/or singular terms herein, those having skill in the art can translate from the plural to the singular and/or from the singular to the plural as is appropriate to the context and/or application. The various singular/plural permutations may be expressly set forth herein for the sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A refrigeration unit comprising:

a refrigeration door, the refrigeration door comprising:

a light source;

a window portion configured to receive light from the light source at a first face, wherein the light exhibits total internal reflection within the window portion;

a plurality of uniformly sized prisms that are non-uniformly spaced apart and each prism comprising a first prism face and a second prism face, the first prism face is configured to eject light outside of the window portion from a second face of the window portion, on which the prisms are disposed, at an angle of about 60 degrees; and a reflective coating disposed on a third face of the window portion opposite to the first face and configured to reflect light back into the window portion, wherein:

the second prism face is configured to eject the reflected light outside of the window portion from the second face of the window portion at an angle of about 30 degrees;

a distance between the prisms decreases as the prisms are disposed further away from the first face; and the uniformly sized prisms are disposed only on the second face of the window portion, and the first prism face and the second prism face of each of the uniformly-sized prisms form a prism having 90°/30°/60° angles with the second face of the window portion.

2. The refrigeration unit door of claim 1, wherein the light source comprises a plurality of LEDs.

3. The refrigeration unit door of claim 1, wherein the light source comprises an LED.

4. The refrigeration unit door of claim 1, wherein the light source is a collimated light source.

5. The refrigeration unit door of claim 1, further comprising an anti-reflective coating located on the second face of the window portion.

6. The refrigeration unit door of claim 1, further comprising an anti-reflective coating located on a fourth face that is opposite the second face.

7. The refrigeration unit door of claim 1, further comprising a collimator configured to collimate the light from the light source.

8. A refrigeration unit comprising:

a refrigeration door comprising:

a collimated light source;

a window portion having a window pane and a film disposed on the window pane, the film comprising a plurality of uniformly-sized prisms, wherein:

the window portion receives light from the light source at a first face;

the light exhibits total internal reflection within the window portion; and the prisms are non-uniformly spaced apart and comprise a first prism face and a second prism face; the first prism face is configured to eject light traveling in a first direction outside of the window portion from a second face of the window portion, on which the prisms are disposed, at a first angle of ejection between 10 and 80 degrees, the prisms are disposed only on the second face of the window portion; and a reflective coating configured to reflect light back into the window portion along a second direction, wherein:

the reflective coating is disposed on a third face of the window portion opposite the first face;

the second prism face is configured to eject the reflected light traveling in the second direction outside of the window portion from the second face of the window portion at a second angle of ejection between 10 and 80 degrees; and a distance between the prisms decreases as the prisms are disposed further away from the first face, wherein the first prism face and the second prism face of each of the uniformly-sized prisms form a prism having 90°/30°/60° angles with the second face of the window portion.

9. The refrigeration unit door of claim 8, wherein the film is an ultra-violet-cured film.

10. The refrigeration unit door of claim 8, wherein the first angle of ejection is about 60 degrees and the second angle of ejection is about 30 degrees.

11. The refrigeration unit door of claim 10, wherein 95% of ejected light traveling in the first direct is ejected at the first angle of ejection and wherein 95% of ejected light traveling in the second direction is ejected at the second angle of ejection.

* * * * *